US009415956B2

(12) United States Patent
Temmaya et al.

(10) Patent No.: US 9,415,956 B2
(45) Date of Patent: Aug. 16, 2016

(54) PAPER FEED DEVICE

(71) Applicant: FUJI XEROX CO., LTD., Tokyo (JP)

(72) Inventors: Takeshi Temmaya, Kanagawa (JP); Eiichiro Yamaguchi, Kanagawa (JP); Yosuke Takahashi, Kanagawa (JP); Marina Matsumoto, Kanagawa (JP); Takeshi Yoneyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/718,935

(22) Filed: May 21, 2015

(65) Prior Publication Data

US 2016/0130097 A1 May 12, 2016

(30) Foreign Application Priority Data

Nov. 12, 2014 (JP) ..... 2014-229542

(51) Int. Cl.

| | |
|---|---|
| ***B65H 3/06*** | (2006.01) |
| ***B65H 3/52*** | (2006.01) |
| ***B65H 1/08*** | (2006.01) |
| ***B65H 1/04*** | (2006.01) |
| ***B65H 1/26*** | (2006.01) |

(52) U.S. Cl.

CPC .. *B65H 1/08* (2013.01); *B65H 1/04* (2013.01); *B65H 1/266* (2013.01); *B65H 3/06* (2013.01); *B65H 3/0676* (2013.01); *B65H 3/0684* (2013.01); *B65H 3/52* (2013.01); *B65H 3/5261* (2013.01)

(58) Field of Classification Search

CPC ..... B65H 3/56; B65H 3/5261; B65H 3/0684; B65H 5/062; B65H 5/068; B65H 1/04

See application file for complete search history.

(56) References Cited

U.S. PATENT DOCUMENTS 5,816,569 A * 10/1998 Hoshi ..... B65H 3/5261 271/117
6,129,347 A * 10/2000 Brooks ..... B65H 3/56 271/122
8,579,432 B2 * 11/2013 Sakano ..... B65H 1/266 347/101

FOREIGN PATENT DOCUMENTS

JP 2000-229737 A 8/2000

* cited by examiner

*Primary Examiner* — Luis A Gonzalez
(74) *Attorney, Agent, or Firm* — Sughrue Mion, PLLC

(57) ABSTRACT

A paper feed device includes: a tray that holds at least one recording medium; a wall that has a portion in contact with a leading end, in a transport direction, of the recording medium on the tray and is disposed so as to intersect the transport direction; and a transport member that is disposed on the downstream side, in the transport direction, of the wall and transports the recording medium. The wall has an opening/closing member that is capable of being opened and closed to form an opening through which the transport member is extracted toward the tray.

9 Claims, 9 Drawing Sheets

PAPER FEED DEVICE

CROSS-REFERENCE TO RELATED APPLICATIONS

This application is based on and claims priority under 35 USC 119 from Japanese Patent Application No. 2014-229542 filed Nov. 12, 2014.

BACKGROUND

Technical Field

The present invention relates to a paper feed device.

SUMMARY

According to an aspect of the invention, there is provided a paper feed device including a tray that holds at least one recording medium; a wall that has a portion in contact with a leading end, in a transport direction, of the at least one recording medium on the tray and is disposed so as to intersect the transport direction; and a transport member that is disposed on the downstream side, in the transport direction, of the wall and transports the at least one recording medium. The wall has an opening/closing member that is capable of being opened and closed to form an opening through which the transport member is extracted toward the tray.

BRIEF DESCRIPTION OF THE DRAWINGS

Exemplary embodiment of the present invention will be described in detail based on the following figures, wherein:

FIGS. 5A and 5B are perspective views of the tray according to the exemplary embodiment of the present invention, wherein FIG. 5A shows a state in which an opening/closing member is closed (i.e., in a normal position), and FIG. 5B shows a state in which the opening/closing member is open (i.e., in a replacement position);

DETAILED DESCRIPTION

Next, an exemplary embodiment of the present invention will be described below with reference to the drawings.

Figure 1:
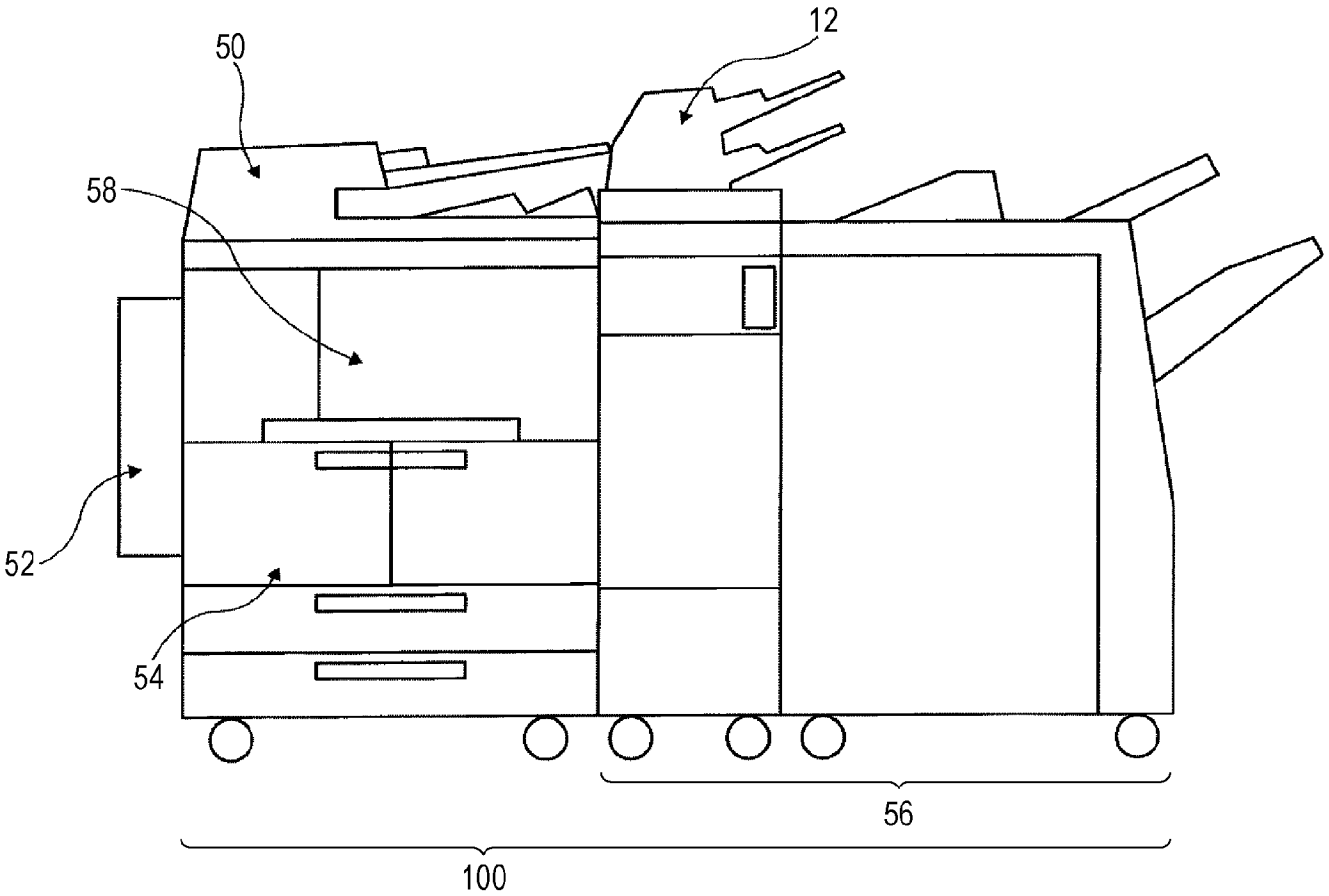
FIG. 1 shows the overall configuration of an image forming apparatus according to an exemplary embodiment of the present invention.

FIG. 1 shows an image forming apparatus 100 according to this exemplary embodiment. The image forming apparatus 100 includes an image forming apparatus body 58. The image forming apparatus body 58 includes an image forming section (not shown) that forms an image on the basis of an image signal inputted from an external device, such as a personal computer. A recording medium feed device 54 that feeds a recording medium to the image forming section, and a manual paper feed device 52 that is used when a recording medium is manually fed are attached to the image forming apparatus body 58. Besides the aforementioned feed devices, there are several types of paper feed devices including: a document feed device 50 that feeds documents; a post-processing device 56 that is connected to the image forming apparatus body 58 and in which a recording medium having an image formed thereon is temporarily kept to wait for post-processing and is then fed for predetermined post-processing; and a paper feed device body 12 that feeds a recording medium, such as a slip sheet, that does not require image formation.

Figure 2:
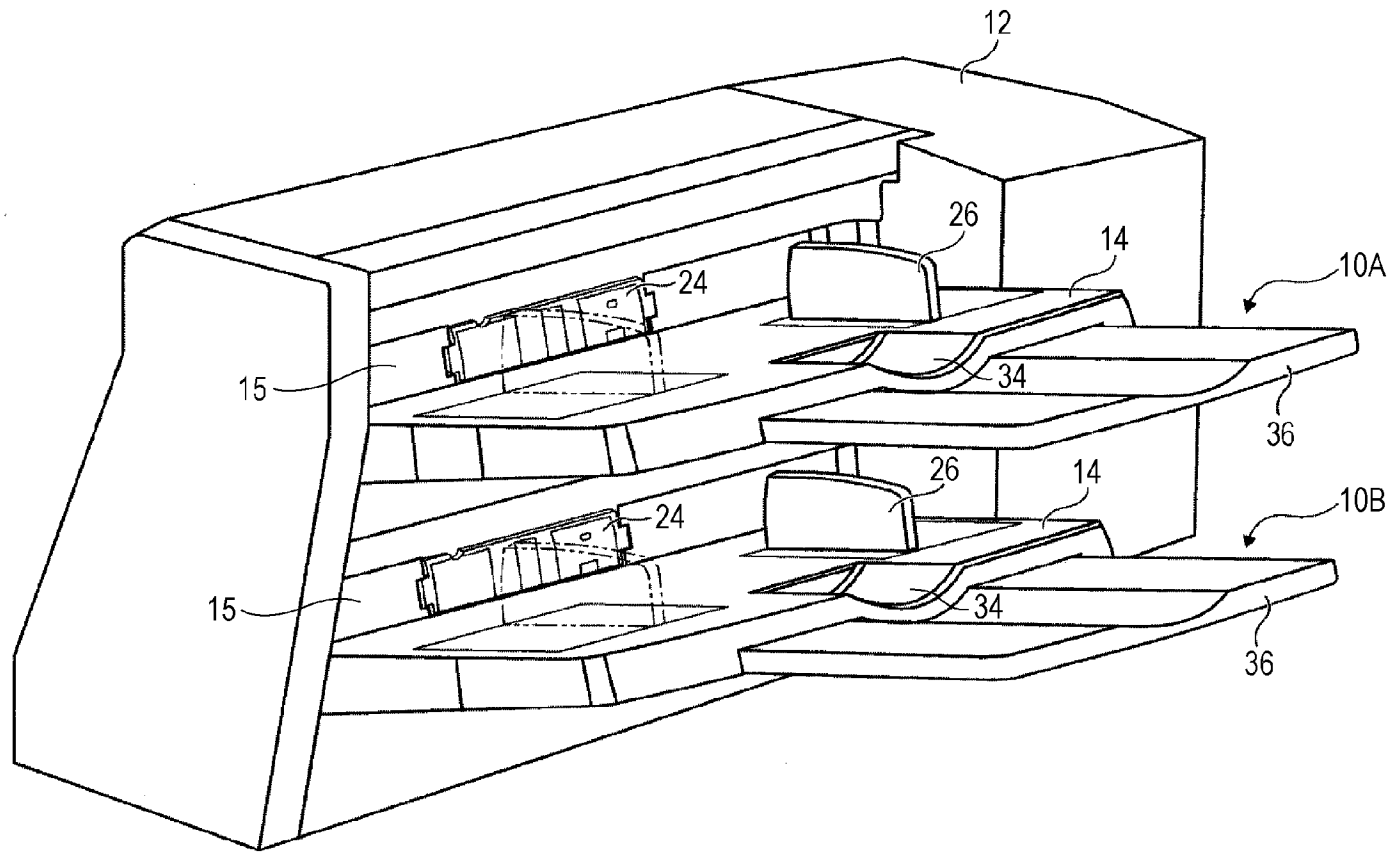
FIG. 2 is a perspective view of a paper feed device body according to the exemplary embodiment of the present invention.

FIG. 2 is a perspective view of the paper feed device body 12 according to this exemplary embodiment.

There are multiple paper feed devices 10 attached to the paper feed device body 12. In this exemplary embodiment, there are an upper paper feed device 10A provided on the upper side and a lower paper feed device 10B provided below the upper paper feed device 10A. The upper paper feed device 10A and the lower paper feed device 10B are provided in a substantially vertical direction and each hold multiple recording media. Because the upper paper feed device 10A and the lower paper feed device 10B have the same configuration, they will be explained as the paper feed device 10.

Figure 3:
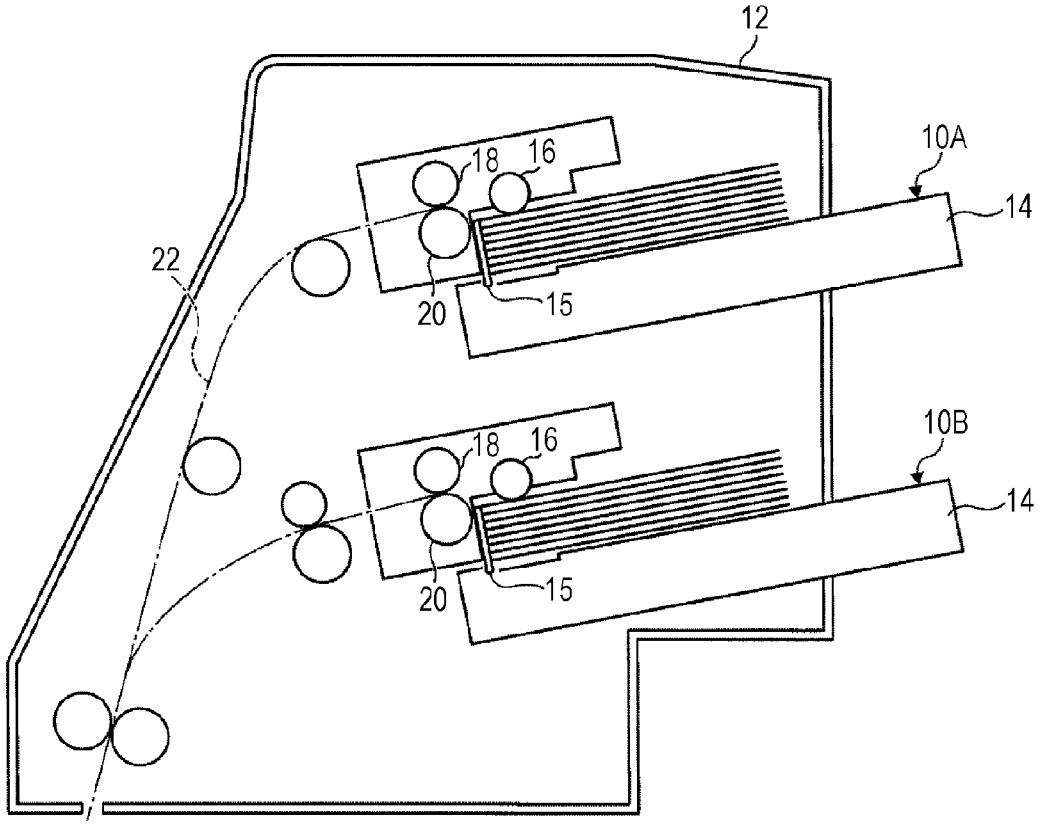
FIG. 3 is a schematic diagram showing the configuration of the paper feed device body according to the exemplary embodiment of the present invention.

FIG. 3 is a schematic diagram showing the configuration of the paper feed device body 12 according to this exemplary embodiment.

The paper feed device 10 includes a tray 14 that holds recording media; a wall 15 standing upright, substantially perpendicular to the tray 14, from a distal end, in the recording-medium transport direction, of the tray 14; a nudger roller 16 that is provided above the wall 15 and serves as a transport member; a feed roller 18 that is provided on the downstream side of the nudger roller 16 in the recording-medium transport direction and serves as a transport member; and a retard roller 20 that is provided opposite the feed roller 18 and serves as a transport member.

The nudger roller 16 picks up recording media on the tray 14 one-by-one and transports them into the paper feed device body 12. The feed roller 18 transports the recording media fed by the nudger roller 16 to an even downstream side. The retard roller 20 that is in contact with the feed roller 18 separates the recording media fed by the nudger roller 16 into individual sheets.

That is, the recording media held on the tray 14 are picked up by the rotation of the nudger roller 16, are transported toward a transport path 22 by the rotation of the feed roller 18 and retard roller 20, and are transported to the post-processing device 56.

Figure 4:
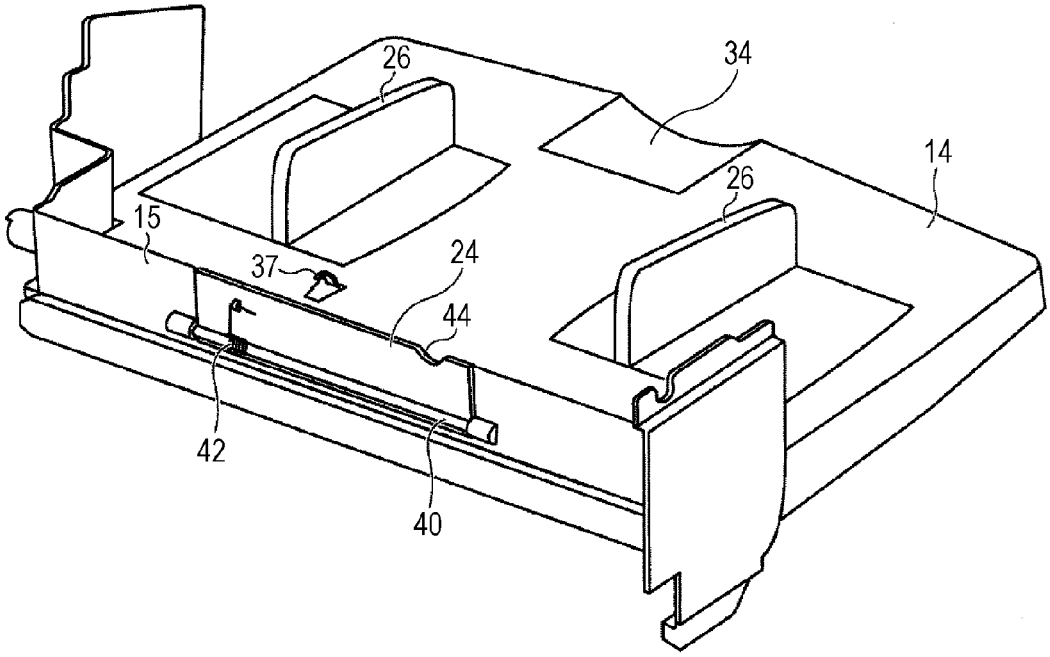
FIG. 4 is a perspective view of a tray according to the exemplary embodiment of the present invention.
Figure 5A:
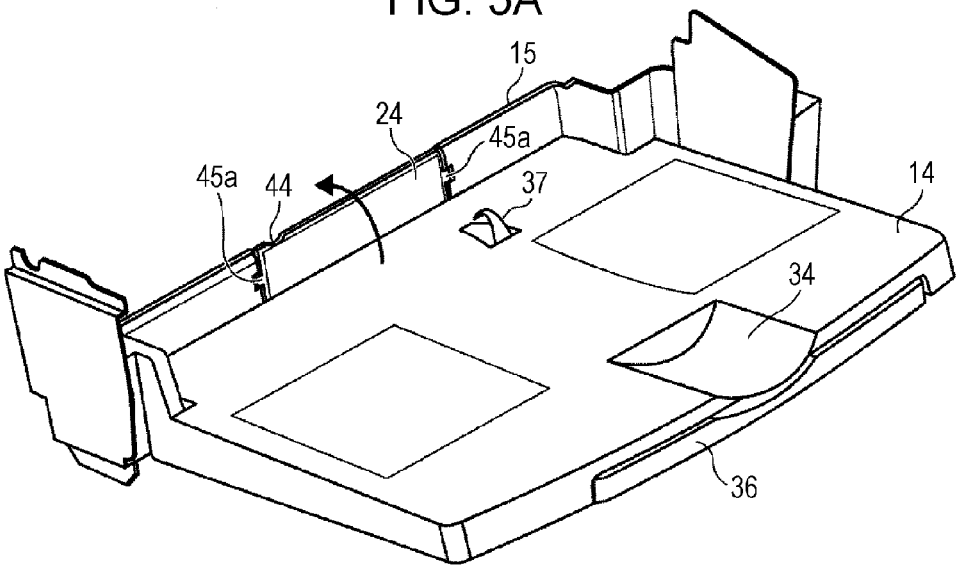
Figure 5B:
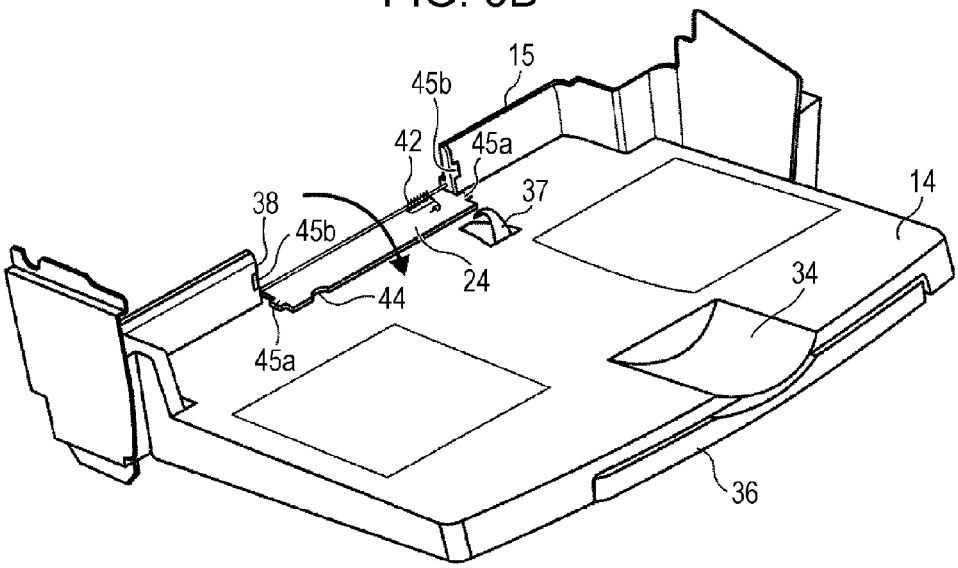

FIG. 4 shows a detailed structure of the tray 14. FIGS. 5A and 5B are perspective views of the tray 14, wherein FIG. 5A shows a state in which an opening/closing member 24 is closed, and FIG. 5B shows a state in which the opening/closing member 24 is open. Note that, because FIGS. 5A and 5B are presented to show the structure of the opening/closing member 24 and the vicinity thereof, the illustration of guide members 26 and 26 is omitted.

The tray 14 has a recess 34 in a holding surface thereof, on which the recording media are placed. The recess 34 is provided substantially in the middle of the upstream end in the recording-medium transport direction. Furthermore, the tray 14 includes an extendable tray 36 that is extendable to the upstream side in the recording-medium transport direction so that it is able to hold recording media having a large length in the recording-medium transport direction. The extendable tray 36 is accommodated in the tray 14 when the recording media are not larger than the tray 14.

Furthermore, the guide members 26 and 26, serving as recording medium guide members, that guide the recording media held by the tray 14 in the transport direction are provided on the holding surface of the tray 14. The guide members 26 and 26 are simultaneously moved in accordance with the width, i.e., the length in a direction perpendicular to the transport direction, of the recording media while holding the middle portion of the recording media. The recording media are transported toward the transport path 22, while being guided by the guide members 26 and 26, with the widthwise ends thereof being aligned.

Furthermore, the tray 14 is provided with a detection sensor 37, serving as a recording medium detection device, that detects the presence of the recording media on the tray 14. When the recording media are placed on the tray 14, the detection sensor 37 senses the presence of the recording media, and the tray 14 is moved up to a position where the recording media are transported by the nudger roller 16. Then, transportation is started.

Note that the wall 15 does not necessarily have to be substantially perpendicular to the tray 14, but may be inclined toward the retard roller 20.

The wall 15 has an opening 38 substantially in the middle. The opening 38 is provided with the opening/closing member 24 that opens or closes the opening 38.

The opening/closing member 24 is supported so as to be able to rotate about a shaft 40 provided at the bottom of the wall 15. Furthermore, the opening/closing member 24 and the wall 15 are urged by an urging portion 42, such as a return spring, and the opening/closing member 24 is urged in a direction in which the opening 38 is closed. That is, the opening/closing member 24 may be tilted from a position flush with the wall 15 toward the tray 14 against the urging force. Furthermore, the opening/closing member 24 has a semicircular notch 44 that is sized to allow a human finger to be inserted, at the upper end thereof, on a control portion side.

The opening/closing member 24 has projections 45*a* and 45*a*, projecting toward the wall 15, at ends adjacent to the wall 15, and the wall 15 has recesses 45*b* and 45*b* in the surface adjacent to the tray 14. The projections 45*a* and 45*a* are engaged with the recesses 45*b* and 45*b*, preventing the opening/closing member 24 from tilting toward the other side of the wall 15 from the tray 14. Hence, without any urging force applied from the outside, the opening/closing member 24 according to this exemplary embodiment is flush with the wall 15 and serves to align the ends of the recording media stacked on the tray 14.

The opening/closing member 24 is normally at a closed position (normal position). When a transport member, such as the nudger roller 16, the feed roller 18, or the retard roller 20 needs to be replaced, the opening/closing member 24 is tilted toward the tray 14, against the urging force, by a finger inserted into the notch 44 up to an open position (replacement position). Then, the transport member is replaced through the opening 38 from the tray 14 side. Thus, in an apparatus having multiple paper feed devices 10 arranged in a substantially vertical direction, it is possible to replace the transport member without needing to remove the other members (units).

Although this exemplary embodiment has described an example in which the notch 44 in the opening/closing member 24 has a semicircular shape that allows a human finger to be inserted therein, the shape of the notch 44 is not limited thereto as long as it allows a human finger to be inserted therein, and it may be triangular, rectangular, or circular. In addition, the positions and shapes of the projections 45*a* and 45*a* and recesses 45*b* and 45*b* for preventing tilting of the opening/closing member 24 are not limited to those described above.

Furthermore, the upper ends of the wall 15 and opening/closing member 24 are rounded to enable smooth transportation of the recording media. Alternatively, the upper ends of the wall 15 and opening/closing member 24 may be sloped, not rounded.

Although this exemplary embodiment has described a configuration in which the opening/closing member 24 is opened and closed by being tilted toward the tray 14 by the urging portion 42, the opening/closing member 24 may be opened and closed by being slid sideways or may be attached to or detached from the wall 15.

Figure 6:
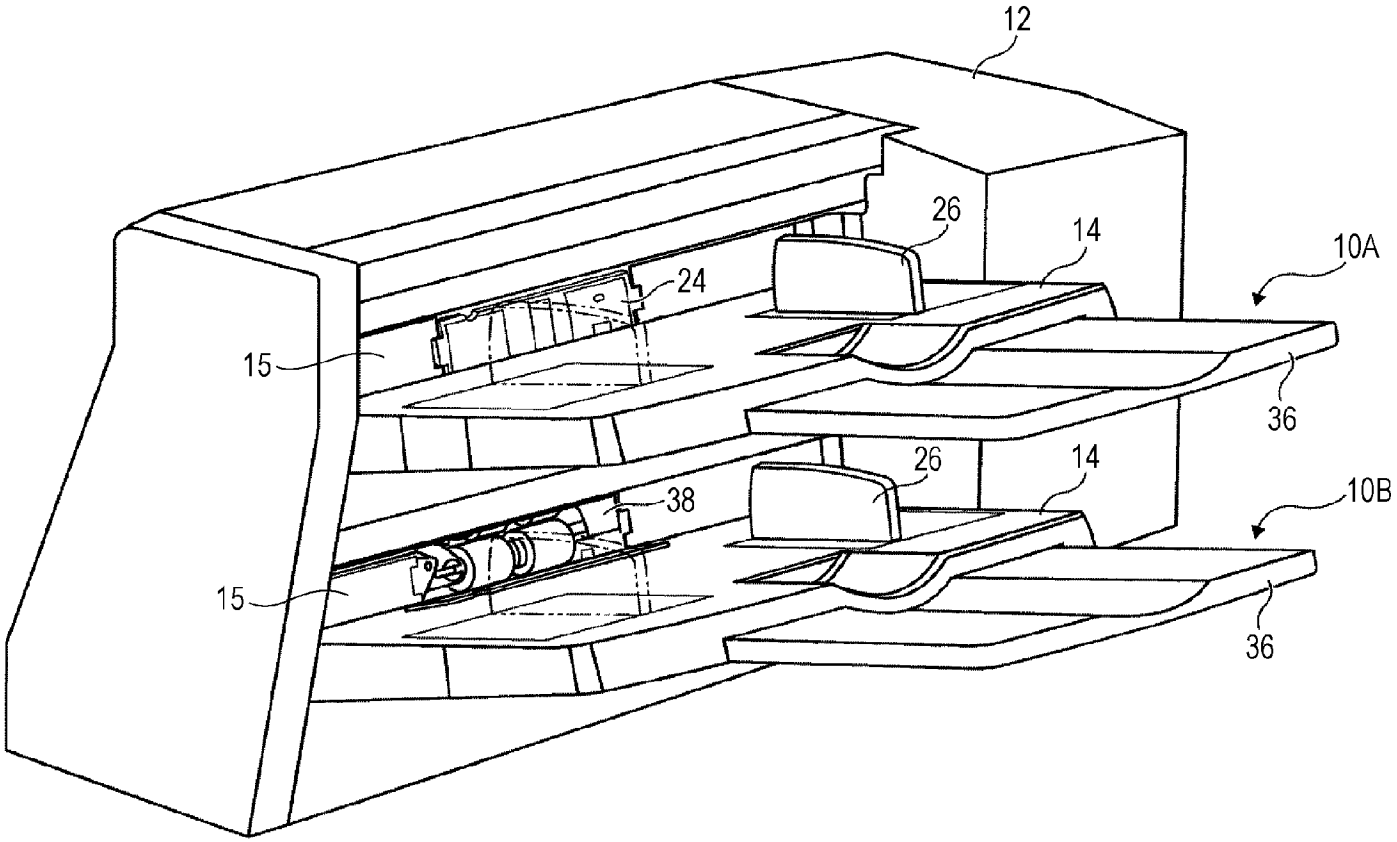
FIG. 6 is a perspective view of the paper feed device body according to the exemplary embodiment of the present invention.
Figure 7:
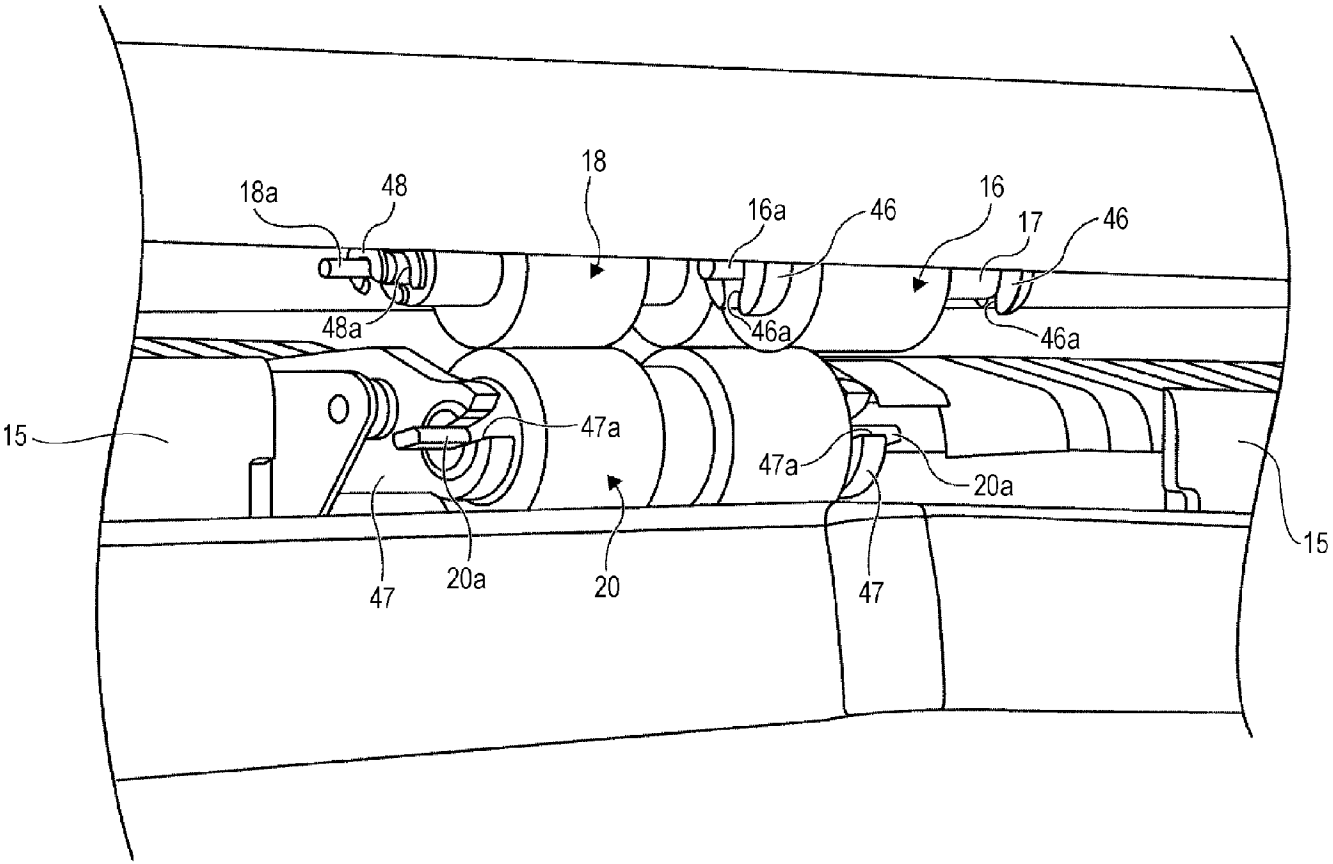
FIG. 7 is an enlarged view of a transport member and the vicinity thereof in FIG. 6.
Figure 8:
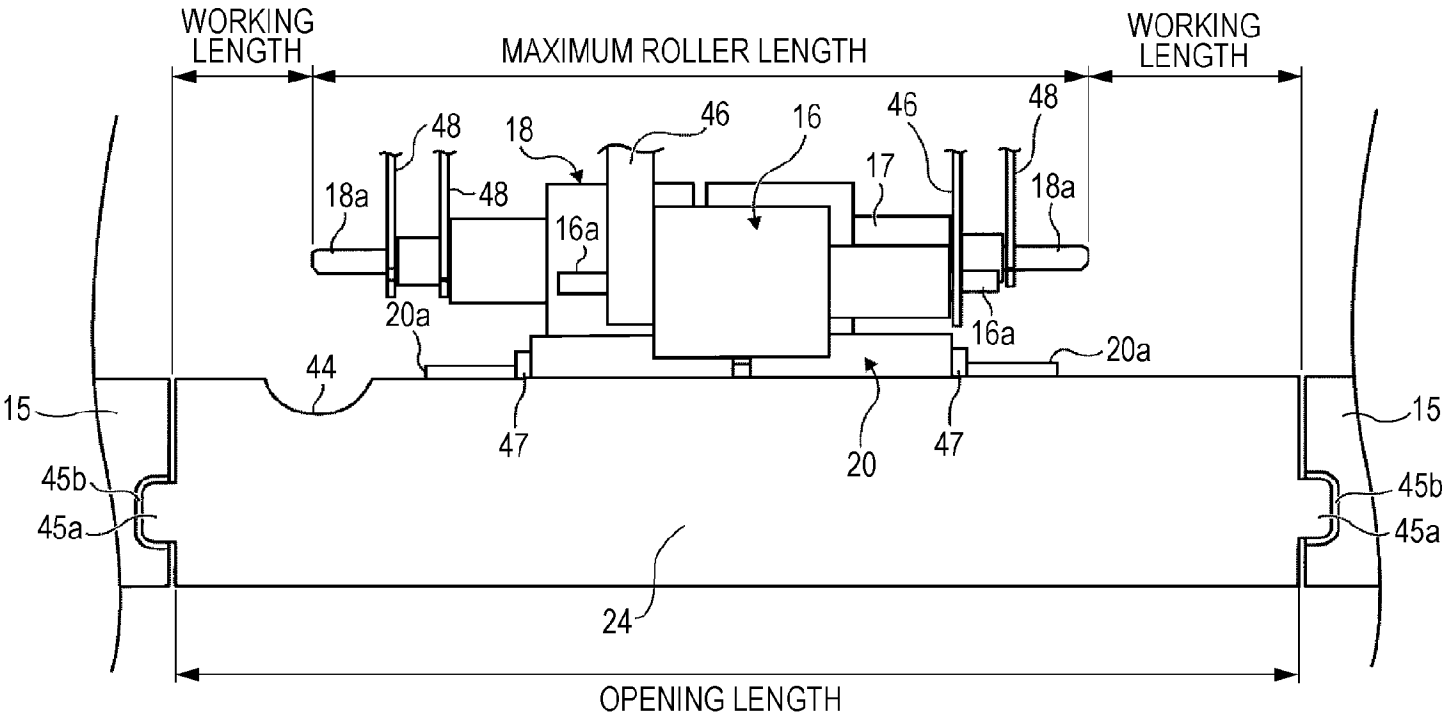
FIG. 8 is a diagram showing the relationship between the transport member and the opening/closing member according to the exemplary embodiment of the present invention.

FIG. 6 is a perspective view of the paper feed device 10 according to this exemplary embodiment, showing replacement of a transport member of the lower paper feed device 10B. FIG. 7 is an enlarged view of the transport member and the vicinity thereof in FIG. 6. Furthermore, FIG. 8 is a diagram showing the relationship between the opening/closing member 24 and the lengths of the respective transport members. Note that, in FIG. 6, for ease of explanation, the guide members 26 on the near side are illustrated with a two-dot chain line, and the detection sensors 37 are not shown.

The nudger roller 16 is connected to the torque limiter 17 and is supported by bearings 46 via a support shaft 16*a*. The feed roller 18 is supported by bearings 48 via a support shaft 18*a*. The retard roller 20 is supported by bearings 47 via a support shaft 20*a*.

In this exemplary embodiment, it is possible to attach or detach the nudger roller 16, the feed roller 18, and the retard roller 20 to or from the bearings by reducing the overall length thereof by holding the ends of the support shaft 16*a*, support shaft 18*a*, and support shaft 20*a*, respectively, with fingers.

The length of the opening/closing member 24 is larger than the maximum roller length, in the axial direction, of the nudger roller 16, feed roller 18, and retard roller 20, and more desirably, it equals the sum of the maximum roller length, in the axial direction, of the nudger roller 16, feed roller 18, and retard roller 20 and the working lengths, i.e., the lengths of working spaces in which fingers hold the rollers. Because the opening 38 has a length equal to the sum of the maximum roller length, in the axial direction, of the transport members and the working lengths, attachment/detachment of the transport members is easy. Although this exemplary embodiment has described the above-described attachment/detachment method, the length should of course be such that it allows attachment/detachment to be performed even in a different roller supporting method, such as a method using a retaining ring.

The bearings 46 have gaps 46*a* oriented toward the bottom in the vertical direction. The nudger roller 16 is attached to or detached from the bearings 46 through the gaps 46*a*. Furthermore, the bearings 47 have gaps 47*a* oriented at an upward angle relative to a direction substantially parallel to the tray 14. The retard roller 20 is attached to or detached from the bearings 47 through the gaps 47*a*. Furthermore, the bearings 48 have gaps 48*a* oriented at an angle toward the tray 14 relative to the bottom in the vertical direction. The feed roller 18 is attached to or detached from the bearings 48 through the gaps 48*a*.

FIGS. 9A to 9D are diagrams showing removal of the transport members.

Figure 9A:
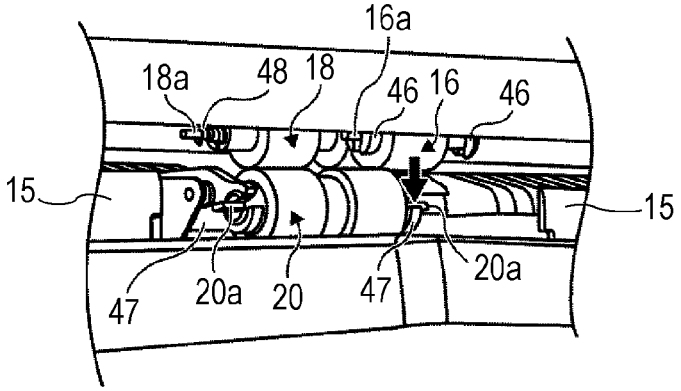
FIGS. 9A to 9D are diagrams showing removal of the transport member according to the exemplary embodiment of the present invention.
Figure 9B:
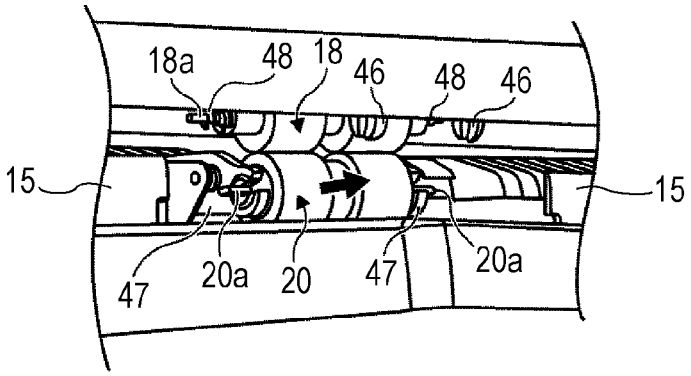

First, the opening/closing member 24 is tilted toward the tray 14 against the urging force, and the nudger roller 16 is removed from the bearings 46 (see FIGS. 9A and 9B).

Figure 9C:
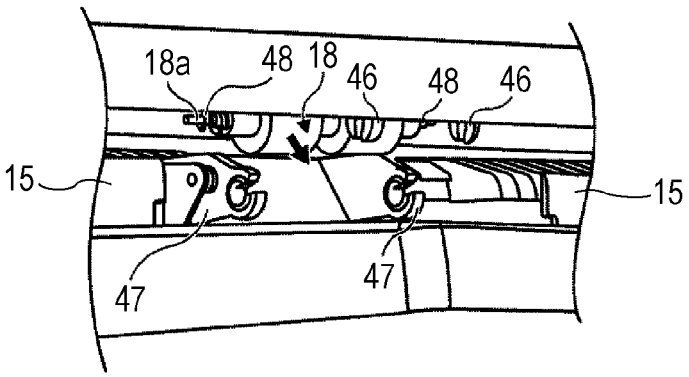
Figure 9D:
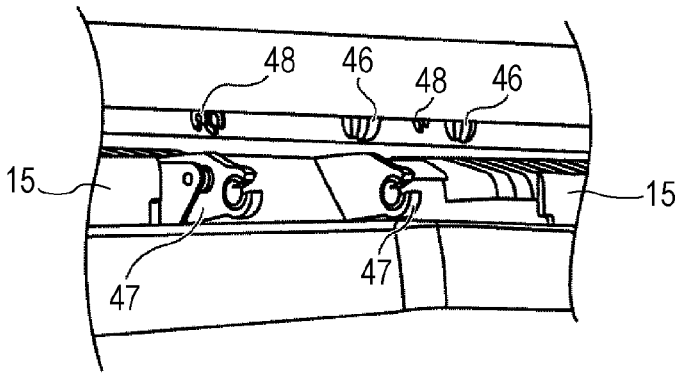

Next, the retard roller 20 is removed from the bearings 47 (FIGS. 9B and 9C). Then, the feed roller 18 is removed from the bearings 48 (FIGS. 9C and 9D).

When the transport members are attached, the above-described removal process is performed in the reverse order.

With the paper feed device according to this exemplary embodiment, the transport members located inside the device body may be attached or detached for maintenance without needing to remove the tray and other units.

Examples of the recording media explained in the above-described exemplary embodiment include documents having images thereon, besides paper to be subjected to image forming.

Furthermore, the paper feed device described in the above exemplary embodiment is applied to sheet feed devices and document sending devices (document feed devices), and also to image forming apparatuses, such as copiers, post-processing devices, facsimile devices, printers, etc., and manual feed trays (manual paper feed devices) of the image forming apparatuses.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A paper feed device comprising:

a tray configured to hold at least one recording medium;

a wall comprising a portion in contact with a leading end, in a transport direction, of the at least one recording medium on the tray, the wall extending in a direction to intersect the transport direction;

a transport member disposed on the downstream side, in the transport direction, of the wall and configured to transport the at least one recording medium; and an urging portion configured to urge an opening/closing member in a direction in which the opening is closed, wherein the wall comprises the opening/closing member that is capable of being opened and closed to form an opening through which the transport member is extracted toward the tray.

2. The paper feed device according to claim 1, wherein the opening/closing member is supported so as to be rotatable about a shaft provided at a lower part of the wall.

3. The paper feed device according to claim 1, wherein the opening/closing member is rotatable against the urging force.

4. The paper feed device according to claim 2, wherein the opening/closing member is supported so as to be rotatable toward the tray.

5. The paper feed device according to claim 3, wherein the opening/closing member is supported so as to be rotatable toward the tray.

6. The paper feed device according to claim 1, wherein when the at least one recording medium comprises recording media, the transport member is a separating roller configured to separate the recording media held by the tray.

7. A paper feed device comprising:

a tray configured to hold at least one recording medium;

a wall comprising a portion in contact with a leading end, in a transport direction, of the at least one recording medium on the tray, the wall extending in a direction to intersect the transport direction, a transport member disposed on the downstream side, in the transport direction, of the wall and configured to transport the at least one recording medium;

wherein the wall has an opening/closing member that is capable of being opened and closed to form an opening through which the transport member is extracted toward the tray, and wherein the opening/closing member comprises a notch at an upper end thereof.

8. The paper feed device according to claim 7, wherein the notch is provided at a position closer to a control portion of the paper feed device in a longitudinal direction of the opening/closing member.

9. The paper feed device according to claim 1, wherein the length of the opening is larger than the maximum length, in an axial direction, of the transport member in a direction parallel to the axial direction.

* * * * *